US005191956A

United States Patent [19]

Ibarrola

[11] Patent Number: 5,191,956

[45] Date of Patent: Mar. 9, 1993

[54] ELECTRONIC METHOD AND CIRCUIT FOR ANALYZING ANALOG SIGNALS

[75] Inventor: Jesus E. Ibarrola, Peralta-Navarra, Spain

[73] Assignee: Azkoyen Industrial, S.A., Peralta Navarra, Spain

[21] Appl. No.: 638,622

[22] Filed: Jan. 8, 1991

[30] Foreign Application Priority Data

Jan. 29, 1990 [ES] Spain ..... 9000252

[51] Int. Cl.[5] ..... G07D 5/08

[52] U.S. Cl. ..... 194/317

[58] Field of Search ..... 194/317, 318, 319

[56] References Cited

U.S. PATENT DOCUMENTS 4,705,154 11/1987 Masho et al. ..... 194/318 X

*Primary Examiner*—F. J. Bartuska

*Attorney, Agent, or Firm*—Helfgott & Karas

[57] ABSTRACT

A method for analyzing analog signals for coin detection comprises establishing, in an analog signal different measurement areas TA, TB, TC, based upon the gradient changes of that signal, to determine a digital signal according to such changes. An electronic circuit is used, which includes an operational amplifier with a time delay that compares the analog signal with the same signal, insignificantly delayed with regard to the signal duration.

3 Claims, 2 Drawing Sheets

ELECTRONIC METHOD AND CIRCUIT FOR ANALYZING ANALOG SIGNALS

FIELD OF THE INVENTION

The present invention relates to a method for analyzing analog signals and the circuit to implement the method, which is specifically useful in the scope of coin selecting devices, for instance game machines, vending machines and in general all sorts of coin-operated machines, ensuring a greater selecting reliability, though they can also be applied to any other practical case requiring a similar performance.

BACKGROUND OF THE INVENTION

It is a well-known fact that the passage of a conducting material, for instance a coin, through an electromagnetic field results in changes in the oscillating circuit associated the such field's exciters, affecting oscillating amplitude and frequency.

Obviously, interaction of the conducting part with the electromagnetic field shall depend upon its dimensional characteristics, for instance, diameter, thickness and snarling, as well as the electrical characteristics thereof, viz. electrical conductivity and magnetic permeability of the alloy.

It is possible to identify the coin being examined by analyzing oscillator variations during the time taken by the coin to go past the sensors.

Different systems of analyzing oscillator variations when the conducting piece goes past the sensors or exciters are known, which establish the maximum variation of the amplitude signal or the maximum drift of the frequency signal, or else and calculate averages of different readings over a given period of time. At all events, signal analysis is not complete and the information obtained is not enough to differentiate between given types of coins or cards.

SUMMARY OF THE INVENTION

The method, subject of the present invention, comprises determining, in an analog signal whose amplitude is provided by a measurement sensor, different measurement areas based upon such signal's gradient changes, from positive to negative or otherwise, generating a digital signal with such gradient changes, in order to establish measurement areas related to the waveform in the analog signal.

The electronic circuit detecting an analog signal wave's gradient changes comprises an operational amplifier for comparing the analog signal with the same signal with a negligible time lag with regard to the time taken by the coin to pass through the measurement sensor.

At each measurement area, time and oscillation frequency measurements are taken in order to establish duration and frequency ratios between each measurement and adjacent areas.

Optionally, the electronic system can be complemented with two pairs of photodiodes or phototransistors, preferably located to the right or left of, above or below the electromagnetic sensor, which furnish information on the speed of each coin or metallic piece as it goes by.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

DESCRIPTION OF THE PREFERRED EMBODIMENT OF THE INVENTION

Figure 1:
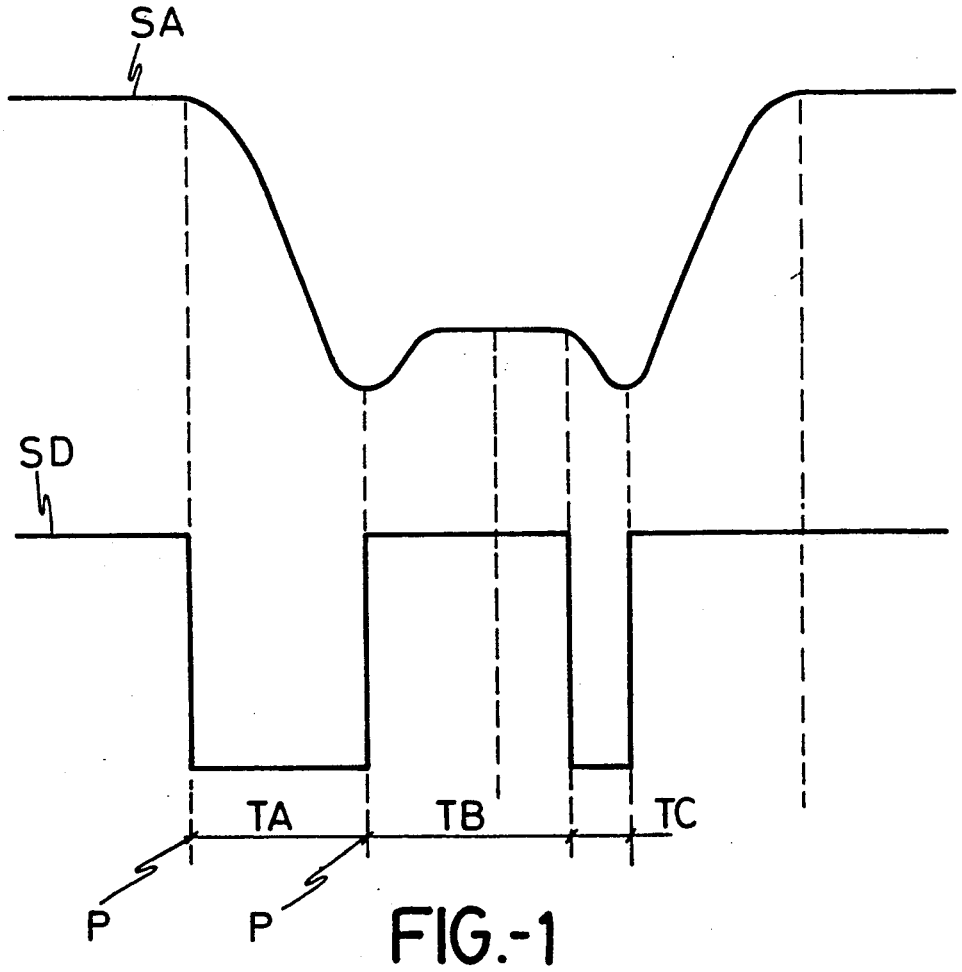
FIG. 1 is a diagram showing a given example of transformation of an analog signal into a digital signal, according to the method of analysis subject hereof.

In the light of these figures, and more specifically FIG. 1, it can be seen that the method subject hereof comprises establishing different measurement areas TA, TB, TC, . . . , in analog signal wave SA provided by a measurement sensor based upon (positive/negative) gradient changes in said analog signal, so that a digital signal SD is achieved at the expense of points P separating different measurement areas corresponding to said analog signal. Thus, variations caused by the coin to be measured passing by can be more thoroughly and accurately analyzed and, therefore, a more reliable identification can be obtained.

Figure 2:
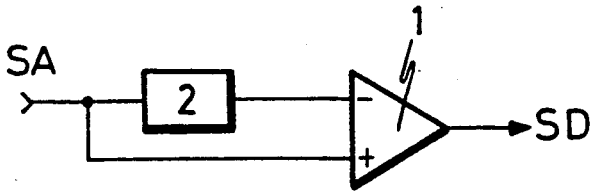
FIG. 2 is a diagram of the basic electronic circuit implementing the procedure.

For the breakdown of the analog signal SA into different areas T, according to FIG. 1, a basic circuit such as that shown in FIG. 2 can be used, comprising an operational amplifier (1) and a time delay (2) at one of the inputs thereto, which allows the analog signal's gradient change points from (+) to (−) and vice versa to be obtained.

As can be seen in FIG. 1, the operational's output is zero when the analog signal's gradient is negative and a logical one when it is zero or positive.

More specifically, an analog signal such as that appearing in FIG. 1 shall be broken down into three measurement areas. The number of measurement areas shall obviously depend upon the complexity of the analog signal. The time delay cell (2) must have a constant time below that taken by the piece to go past the sensor's exciters and can be of the RC type.

Figure 3:
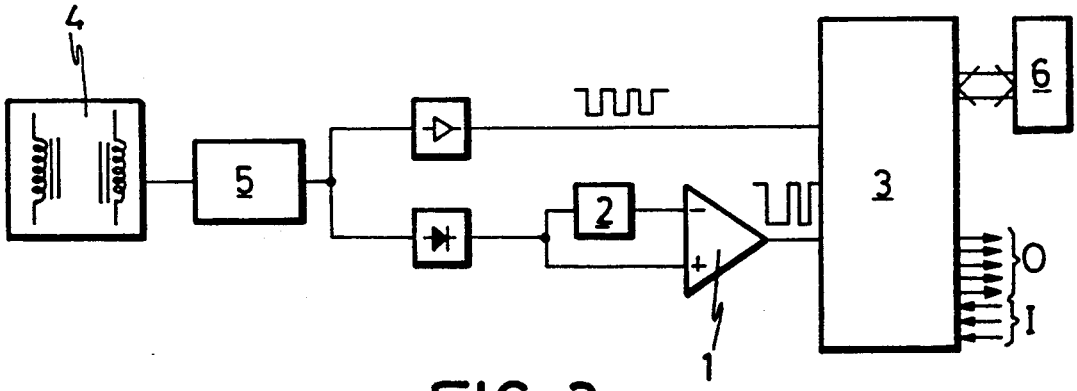
FIG. 3 shows the basic circuit of FIG. 2 implemented in the general signal treatment circuit, provided with the relevant microprocessor.

FIG. 3 shows the electronic circuit for the treatment of the signals, which generally comprises a microprocessor (3) that will measure the time or measurement areas TA, TB, TC shown in FIG. 1, as well as the frequency in each of these areas defined by the proposed circuit.

Once the piece to be measured has left the electromagnetic sensor (4), duration and frequency ratios can be established between each of the areas with regard to the adjacent areas, such ratios being parameters that can be used in identifying the coins or metallic pieces.

As is also clear from FIG. 3, coupled at the sensor (4) output, and as is normally the case, is the oscillator (5) that sends a signal straight to the microprocessor and another one through the basic circuit of FIG. 2, which microprocessor (3) will be provided with the relevant program memory.

Figure 4:
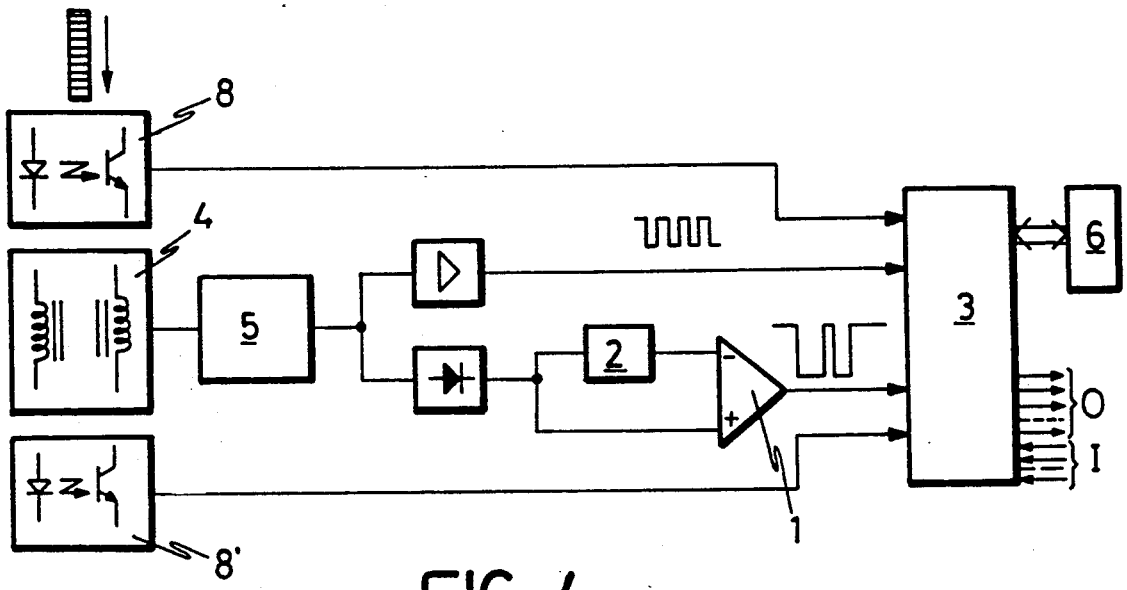
FIG. 4 is a different embodiment of the circuit of FIG. 3, the circuit being complemented with two pairs of photodiodes-phototransistors for the measurement to be more accurate.

Optionally, for a more accurate measurement and according to FIG. 4, the circuit of FIG. 3 can be completed with additional means to measure the diameter of coin (7), comprising two pairs of photodiodes-phototransistors (8—8), preferably located to the right and left of the electromagnetic sensor (4), furnishing the microprocessor (3) with information on the speed at which the piece, in other words, coin (7) or the element at issue to be measured is passing by. Once the speed is known, the time measurements of each of the measurement areas can be standardized or adjusted and therefore rendered independent of the speed at which such piece to be measured passes by, which speed shall vary according to the device's slope, the characteristics of the coin guide and so forth.

We feel that the device has now been sufficiently described for any expert in the art to have grasped the full scope of the invention and the advantages it offers.

The materials, shape, size and layout of the elements may be altered provided that this entails no modification of the essential features of the invention.

The terms used to describe the invention herein should be taken to have a broad rather than a restrictive meaning.

I claim:

1. Method for analyzing analog signals applicable to electronic selectors of coins and like metallic pieces comprising the steps of establishing in an analog signal an amplitude which is provided by a measurement sensor, of different measurement areas based upon positive/negative gradient changes in said analog signal and adapting said changes to a digital signal in order to establish measurement areas related to a waveform of the analog signal wherein time and oscillation frequency are measured at each of the measurement areas in order to establish duration and frequency ratios between each measurement area and adjacent areas.

2. Electronic circuit for analyzing analog signals applicable to electronic selectors of coins and like metallic pieces, comprising a single sensor for establishing in an analog signal indicative of a parameter of a coin or the like metallic piece passing said sensor of different measurement areas defined by positive/negative gradient changes in said analog signal; an oscillator connected to said sensor; a microprocessor connected to said oscillator and receiving said signal from said sensor through said oscillator; an operational amplifier; and a time delay connected to one of inputs of said amplifier, said amplifier being connected between said oscillator and said microprocessor, said amplifier receiving signals from said sensor through said oscillator, comparing the analog signal with a delayed signal of the same, and supplying the same to said microprocessor to measure time and oscillation frequency in each of the measured areas and adapt said changes to a digital signal in order to establish measurement areas related to a waveform of said analog signal.

3. Electronic circuit for analyzing analog signals, according to claim 2, further comprising two pairs of photodiodes-phototransistors furnishing the microprocessor with information on a speed at which each coin is passing the sensor.

* * * * *